US008120499B2

(12) United States Patent
Ortiz

(10) Patent No.: US 8,120,499 B2
(45) Date of Patent: Feb. 21, 2012

(54) BABY CORD

(76) Inventor: San Juanita Ortiz, Corpus Christi, TX (US)

( * ) Notice: Subject to any disclaimer, the term of this patent is extended or adjusted under 35 U.S.C. 154(b) by 373 days.

(21) Appl. No.: 12/414,787

(22) Filed: Mar. 31, 2009

(65) Prior Publication Data

US 2009/0243861 A1 Oct. 1, 2009

Related U.S. Application Data

(60) Provisional application No. 61/040,931, filed on Mar. 31, 2008.

(51) Int. Cl.
*G08B 23/00* (2006.01)

(52) U.S. Cl. ..... 340/573.1; 340/457.1

(58) Field of Classification Search ..... 340/573.1, 340/457.1, 667
See application file for complete search history.

(56) References Cited

U.S. PATENT DOCUMENTS

| | | | | |
|---|---|---|---|---|
| 5,678,854 | A * | 10/1997 | Meister et al. | 280/735 |
| 5,949,340 | A | 9/1999 | Rossi | |
| 5,971,432 | A | 10/1999 | Gagnon et al. | |
| 6,104,293 | A | 8/2000 | Rossi | |
| 6,812,844 | B1 | 11/2004 | Burgess | |
| 7,225,067 | B2 | 5/2007 | Sleboda et al. | |
| 7,466,221 | B1 * | 12/2008 | Lehr | 340/457.1 |

* cited by examiner

*Primary Examiner* — Shirley Lu
(74) *Attorney, Agent, or Firm* — James Ray & Assoc

(57) ABSTRACT

The present invention, in one embodiment, is a belt like device comprised of two sections connected together with magnets. The free ends of the two sections can be equipped with clips for securing each section to either child or caregiver. When the caregiver gets out of the vehicle the magnets and their respective sections separate, and a tune, tone, song, or some other audible signal is played through a speaker on the device. The audible signal could be activated by the use of a magnetic sensor or magnetic switch. The audible signal would alert and remind the caregiver that a child is still in the vehicle.

6 Claims, 5 Drawing Sheets

BABY CORD

CROSS REFERENCE TO RELATED APPLICATION

This patent application is related to and claims priority from U.S. Provisional Patent Application Ser. No. 61/040,931 filed Mar. 31, 2008.

FIELD OF THE INVENTION

The present invention relates, in general, to child safety devices and, more particularly, this invention relates to a child safety device to help prevent child from being forgotten and left in vehicles.

BACKGROUND OF THE INVENTION

Prior to the conception and development of the present invention, and as is generally well known in the prior art, parents and caregivers through forgetfulness leave young children alone in parked vehicles. This creates a health and safety risk for the child, especially if the outside temperature is particularly hot or cold. These dangers have been known to cause hypothermia, hyperthermia, dehydration or even the death of young children. Additionally, the forgetful parent or care giver could face criminal charges for leaving a child unattended in a vehicle.

SUMMARY OF THE INVENTION

The present invention, in one embodiment, is a belt like device comprised of two sections connected together with magnets. The free ends of the two sections can be equipped with clips for securing each section to either child or caregiver. Additionally, it is foreseen that a free end could be attached to a child's car seat instead of the child directly. It is envisioned that almost any securing means could be used for securing the free ends to either child or caregiver, including using straps as the sections and simply tying the free ends to child and caregiver. When the caregiver gets out of the vehicle the magnets and their respective sections separate, and a tune, tone, song, or some other audible signal is played through a speaker on the device. The audible signal could be activated by the use of a magnetic sensor or magnetic switch. The audible signal would alert and remind the caregiver that a child is still in the vehicle.

Additionally, the belt like device creates a conscious and physical connection between caregiver and child, aiding in reminding the caregiver of the child's presence in the vehicle.

OBJECTS OF THE INVENTION

It is, therefore, one of the primary objects of the present invention to provide a child safety device that alerts a caregiver of a child in the vehicle they are exiting.

Another object of the present invention is to provide a child safety device with a physical and visual connection between child and caregiver.

Still another object of the present invention is to provide a child safety device that audibly alerts a caregiver of a child in the vehicle they are exiting without waking the child if they are asleep.

In one embodiment the invention is a child safety device comprising: a first strap segment with at least one magnet attached to said first strap segment, a second strap segment with at least one magnet attached to said second strap segment, an audible signal generating device, a speaker electrically connected to said audible signal generating device, a battery, a magnetic switch electrically connecting said battery to said audible signal generating device, wherein the magnetic switch is open when the at least one magnet attached to said first strap segment is proximate to the at least one magnet attached to said second strap segment. In another embodiment the invention further comprises a manual switch for manually electrically disconnecting said battery from said audible signal generating device. In another embodiment the invention further comprises a first fastener on said first strap segment, and a second fastener on said second strap segment. In another embodiment the invention further comprises a first clip on said first strap segment, and a second clip on said second strap segment. In another embodiment said first strap segment is adjustable in length. In another embodiment said second strap segment is adjustable in length. In another embodiment said first strap segment is adjustable in length, and said second strap segment is adjustable in length.

In yet another embodiment the invention is a child safety device comprising: a first strap segment with at least one magnet attached to said first strap segment, a second strap segment with at least one magnetic sensor connected to said second strap segment, an audible signal generating device, a speaker electrically connected to said audible signal generating device, a battery, wherein said at least one magnetic sensor electrically connects said battery to said audible signal generating device, and the audible signal generating device generates an audible signal when the at least one magnet attached to said first strap segment is not proximate to the magnetic sensor attached to said second strap segment. In another embodiment the invention further comprises a manual switch for manually electrically disconnecting said battery from said audible signal generating device. In another embodiment the invention further comprises a first fastener on said first strap segment, and a second fastener on said second strap segment. In another embodiment the invention further comprises a first clip on said first strap segment, and a second clip on said second strap segment. In another embodiment said first strap segment is adjustable in length. In another embodiment said second strap segment is adjustable in length. In another embodiment said first strap segment is adjustable in length, and said second strap segment is adjustable in length.

In yet still another embodiment the invention is a child safety device comprising: a first strap segment with at least one normally closed magnetic switch attached to said first strap segment, a second strap segment with at least one magnet attached to said second strap segment, an audible signal generating device, a speaker electrically connected to said audible signal producing device, a battery, a magnetic switch electrically connecting said battery to said audible signal producing device, wherein the magnetic switch is open when the at least one magnet attached to said first strap segment is proximate to the at least one magnet attached to said second strap segment. In another embodiment the invention further comprises a manual switch for manually electrically disconnecting said battery from said audible signal generating device. In another embodiment the invention further comprises a first fastener on said first strap segment, and a second fastener on said second strap segment. In another embodiment the invention further comprises a first clip on said first strap segment, and a second clip on said second strap segment. In another embodiment said first strap segment is adjustable in length. In another embodiment said second strap segment is adjustable in length.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention; and together with the description serve to explain the principles and operation of the invention.

Figure 1:
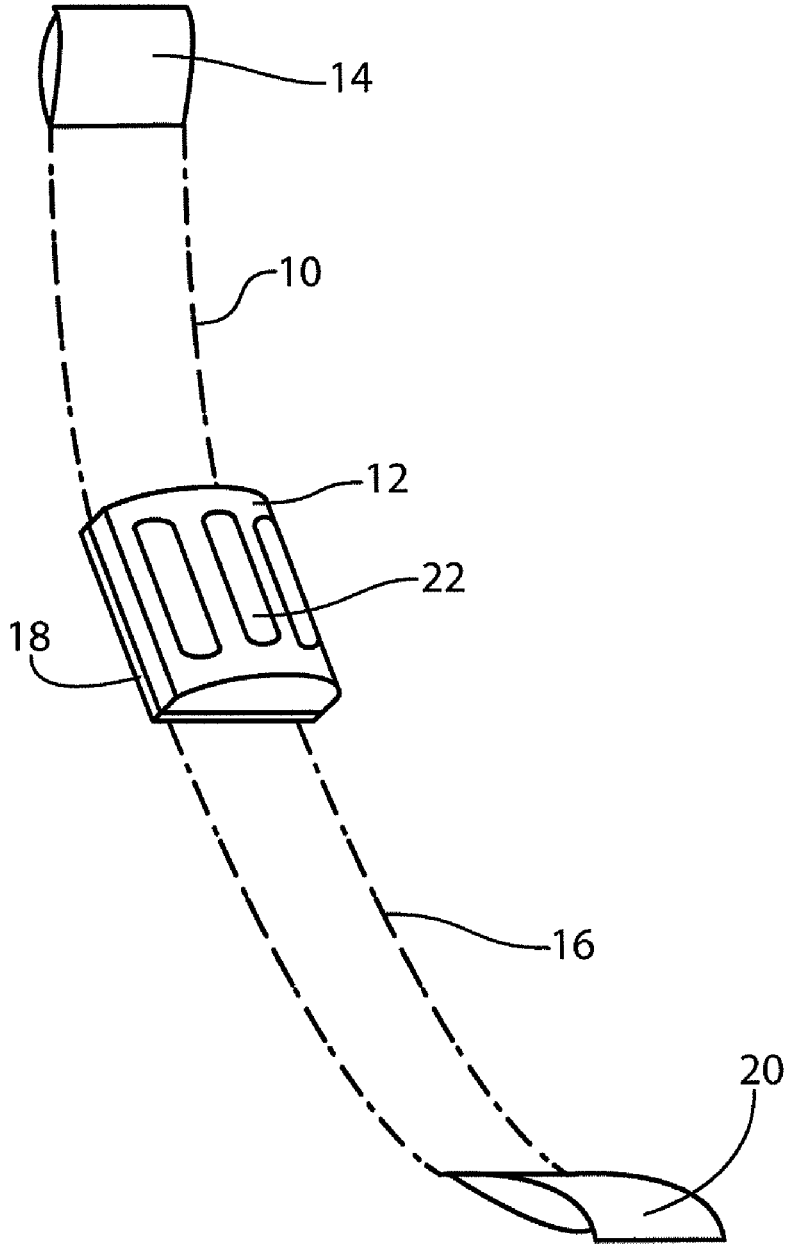
FIG. 1 is a general schematic view of one embodiment of the present invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIG. 1 a general schematic view of one embodiment of the present invention. One end of caregiver strap section 10 is attached to speaker housing 12, the other end of strap section 10 is attached to fastening clip 14. One end of child strap section 16 is attached to magnet housing 18, the other end of strap section 16 is attached to fastening clip 20. In the current embodiment, speaker housing 12 contains a speaker 22, a digital audio player (not shown), a normally closed magnetic switch (not shown) and a battery (not shown). In the current embodiment magnet housing 18 contains at least one magnet or element capable of producing a magnetic field.

Figure 2:
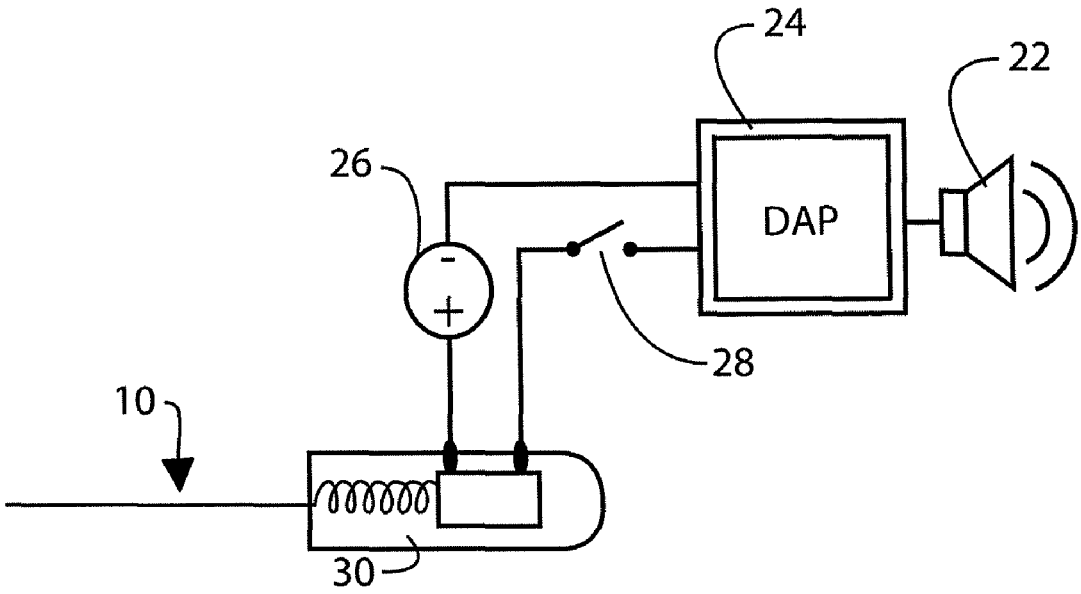
FIG. 2 a schematic view of one embodiment of the internal elements of the speaker housing.

Reference is now made to FIG. 2 a schematic view of the internal elements of speaker housing 12. Speaker 22 is electrically connected to digital audio player 24. Digital audio player is electrically connected to battery 26 through normally closed magnetic switch 30. Digital audio player 24 being capable of storing, processing, and amplifying audio signals to create sound through speaker 22. Optional manual switch 28 could be incorporated to disable sound and to conserve battery power while the present invention is not in use.

Figure 3:
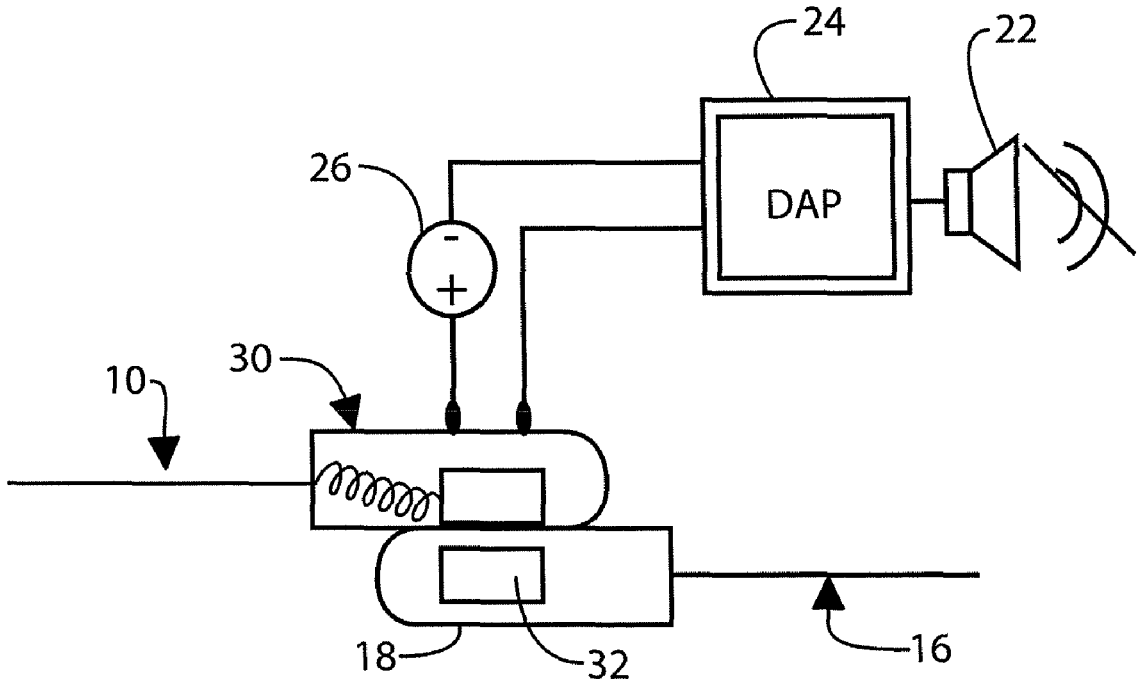
FIG. 3 a schematic view of one embodiment of the internal elements of the speaker housing with magnet housing in proximity and secured to speaker housing.

Reference is now made to FIG. 3 a schematic view of the internal elements of speaker housing 12 with magnet housing 18 in proximity and secured to speaker housing 12. As magnet housing 18, containing magnet 32, comes into proximity or contact with speaker housing 12, magnetic switch 30 opens cutting power to digital audio player 24. This causes speaker 22 to stop producing sound.

Figure 4:
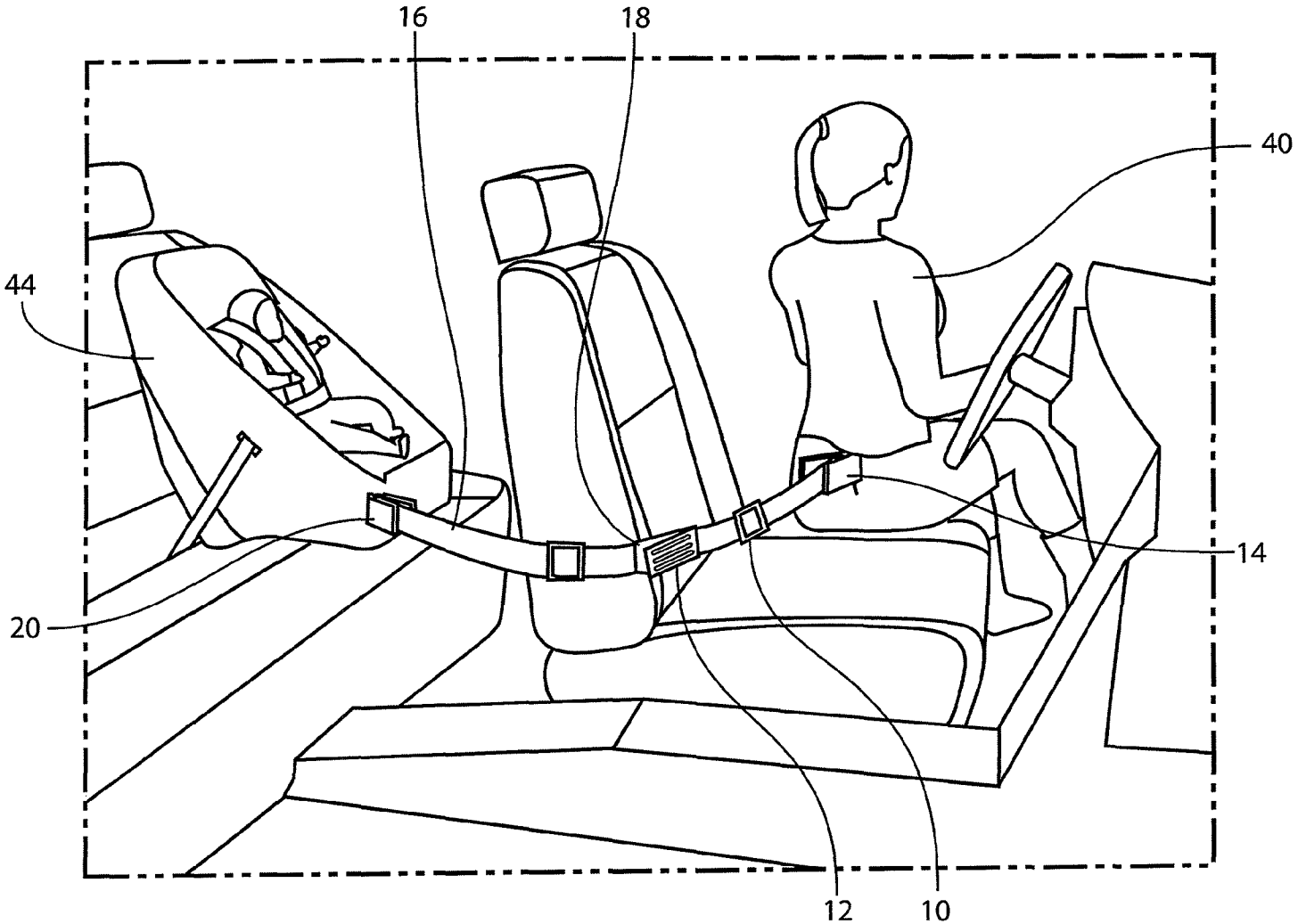
FIG. 4 is a perspective view of one embodiment of the present invention while in use.

Reference is now made to FIG. 4 a perspective view of one embodiment of the present invention while in use. One end of caregiver strap section 10 is attached to speaker housing 12, the other end of strap section 10 is attached to fastening clip 14, which is clipped to caregiver 40. One end of child strap section 16 is attached to magnet housing 18, the other end of strap section 16 is attached to fastening clip 20, which is clipped to child's seat 44.

Figure 5:
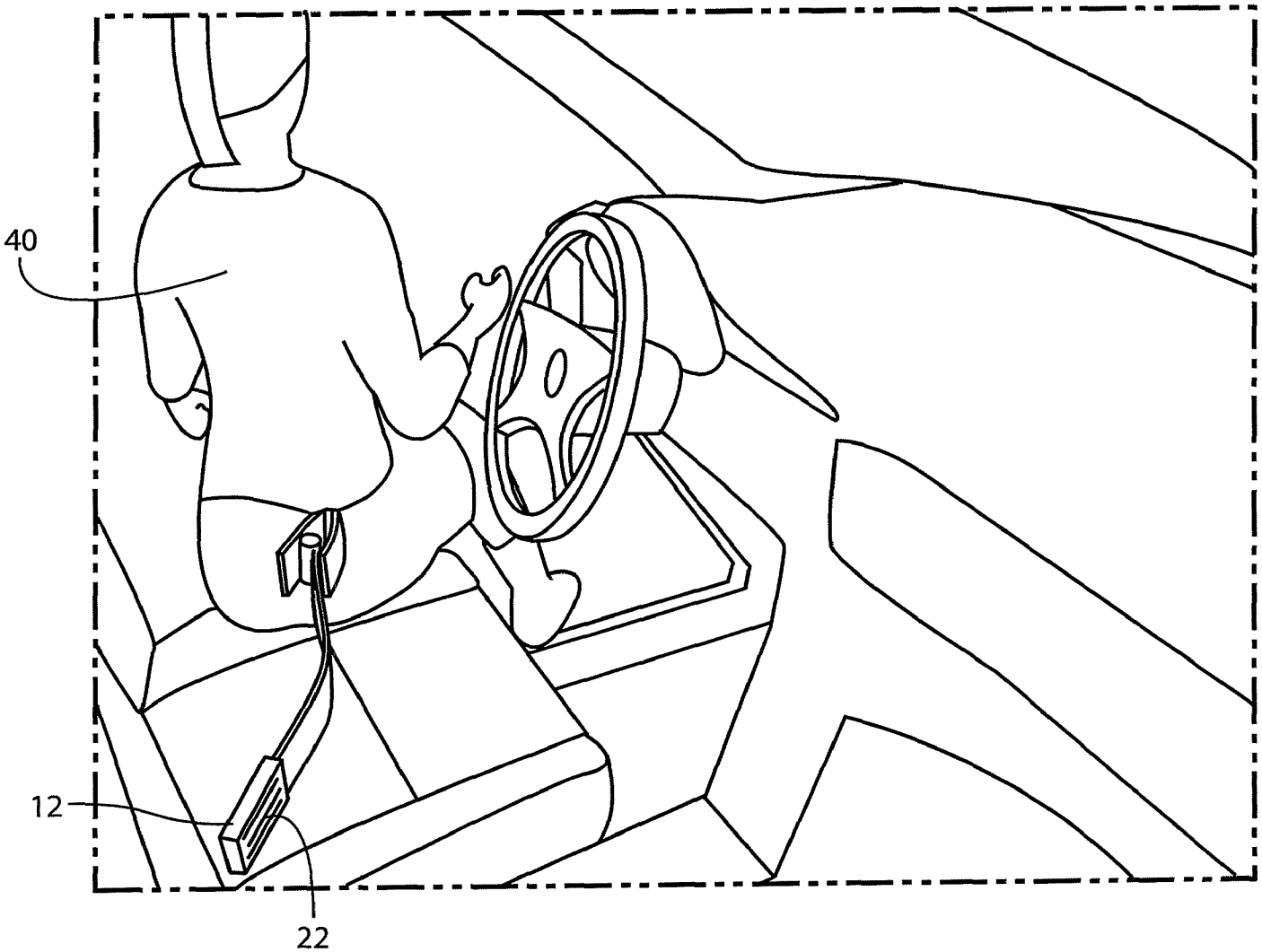
FIG. 5 is a perspective view of one embodiment of the present invention being activated.

Reference is now made to FIG. 5 a perspective view of one embodiment of the present invention being activated. When caregiver 40 exits a vehicle, speaker housing 12 and magnet housing 18 become uncoupled and the speaker 22 plays predetermined sound.

Figure 6:
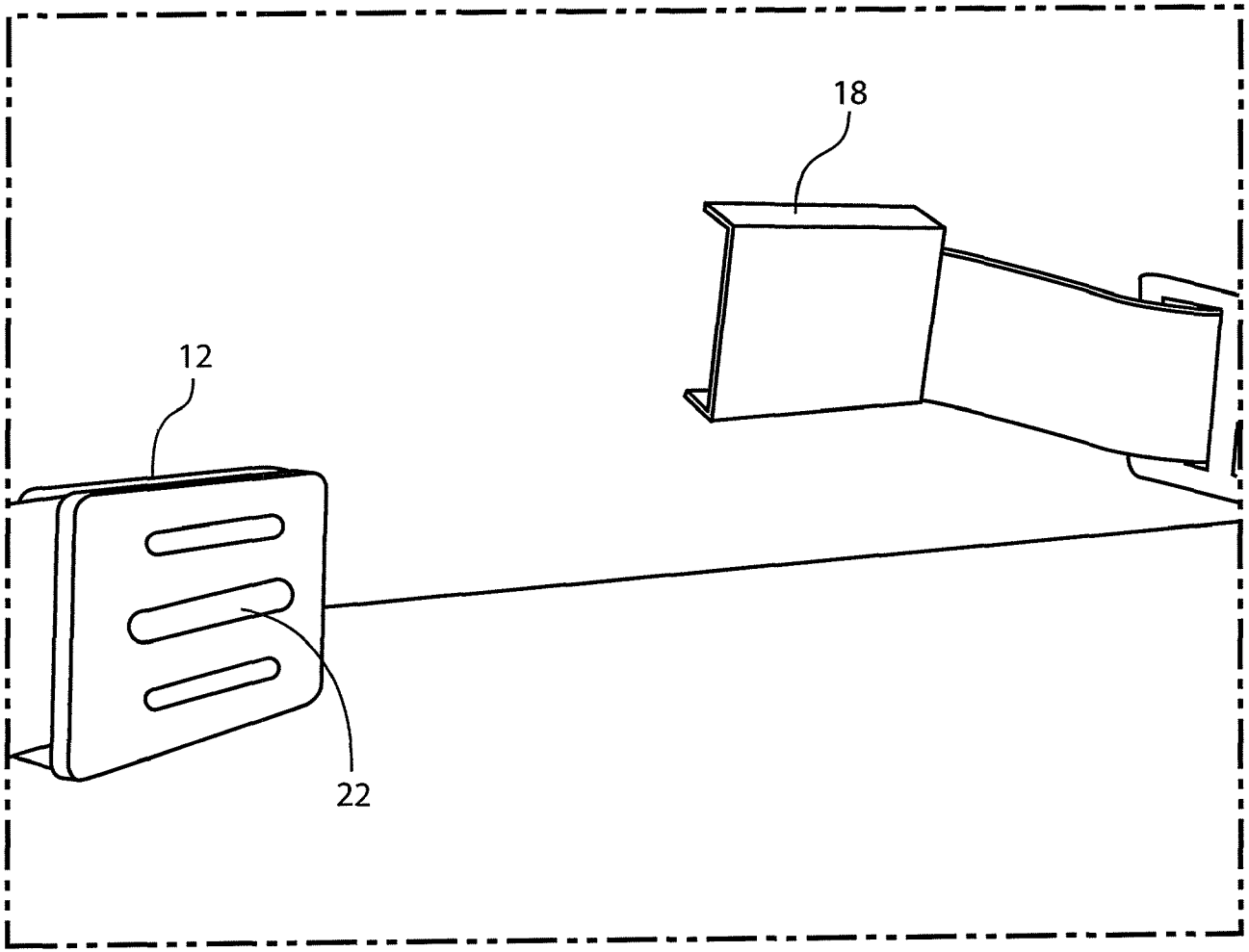
FIG. 6 is a close up view of one embodiment of the present invention while activated.

Reference is now made to FIG. 6 a close up view of one embodiment of the present invention while activated. The coupling means between speaker housing 12 and magnet housing 18 could be any means know in the art or a combination of these means, which could include the use of magnets, electromagnets, clips, snap buttons, hook and loop fasteners, or any like means of fastening that can be undone by the application of tension to the strap segments. Also, it is specifically envisioned that the straps could be of an adjustable type. Also, it is specifically envisioned that a magnetic sensor could be employed instead of a magnetic switch.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

What is claimed:

1. A child safety device comprising:

a first strap segment with at least one magnet attached to a first end of said first strap segment, a second strap segment with at least one magnet attached to a first end of said second strap segment, an audible signal generating device disposed at said first end of one of said first and second strap segments, a speaker electrically connected to said audible signal generating device, a battery, a first fastening clip on a second end of said first strap segment, wherein said first strap segment is attached to one of a child seat and a caregiver, a second fastening clip on a second end of said second strap segment, wherein said second strip segment is attached to an opposite one of said child seat and said caregiver, a magnetic switch electrically connecting said battery to said audible signal generating device, wherein said magnetic switch is open when said at least one magnet attached to said first strap segment is proximate to said at least one magnet attached to said second strap segment, and wherein said magnetic switch is closed when said at least one magnet attached to said first strap segment moves away from said at least one magnet attached to said second strap segment causing electrical connection between said battery and said audible signal generating device.

2. A child safety device as in claim 1, further comprising a manual switch for manually electrically disconnecting said battery from said audible signal generating device.

3. A child safety device as in claim 1, wherein said first strap segment is adjustable in length.

4. A child safety device as in claim 1, wherein said second strap segment is adjustable in length.

5. A child safety device as in claim 1, wherein said first strap segment is adjustable in length, and said second strap segment is adjustable in length.

6. A child safety device of claim 1, wherein one of said at least one magnet is disposed within a magnet housing having a pair of flanges defining a generally U-shape of said housing.

* * * * *